US009273689B2

(12) United States Patent
Birk

(10) Patent No.: US 9,273,689 B2
(45) Date of Patent: Mar. 1, 2016

(54) VALVE ARRANGEMENT, CONNECTION PLATE FOR A HYDROSTATIC PISTON MACHINE, AND HYDROSTATIC PISTON MACHINE

(75) Inventor: Sebastian Birk, Sulz (DE)

(73) Assignee: Robert Bosch GmbH, Stuttgart (DE)

( * ) Notice: Subject to any disclaimer, the term of this patent is extended or adjusted under 35 U.S.C. 154(b) by 393 days.

(21) Appl. No.: 13/819,180

(22) PCT Filed: Aug. 5, 2011

(86) PCT No.: PCT/EP2011/003928

§ 371 (c)(1),
(2), (4) Date: May 13, 2013

(87) PCT Pub. No.: WO2012/025193

PCT Pub. Date: Mar. 1, 2012

(65) Prior Publication Data

US 2013/0224045 A1 Aug. 29, 2013

(30) Foreign Application Priority Data

Aug. 26, 2010 (DE) ..... 10 2010 035 457

(51) Int. Cl.
*F04C 14/24* (2006.01)
*F04B 1/20* (2006.01)
(Continued)

(52) U.S. Cl.
CPC ..... *F04C 14/24* (2013.01); *F04B 1/2042* (2013.01); *F04B 49/08* (2013.01); *F04B 49/22* (2013.01)

(58) Field of Classification Search
CPC ..... F04B 9/02; F04B 9/22; F04B 9/24; F04B 9/243; F04B 9/246; F04B 1/2042; F04C 14/26; F04C 15/064; F04C 14/24
USPC ..... 417/315
See application file for complete search history.

(56) References Cited

U.S. PATENT DOCUMENTS 4,367,638 A * 1/1983 Gray ..... 62/324.6
2009/0185923 A1* 7/2009 Sato et al. ..... 417/545

FOREIGN PATENT DOCUMENTS

DE 42 34 139 A1 4/1994
DE 103 60 959 A1 7/2005
(Continued)

OTHER PUBLICATIONS

International Search Report corresponding to PCT Application No. PCT/EP2011/003928, mailed Nov. 8, 2011 (German and English language document) (5 pages).
(Continued)

*Primary Examiner* — Charles Freay
*Assistant Examiner* — Kenneth J Hansen
(74) *Attorney, Agent, or Firm* — Maginot, Moore & Beck LLP

(57) ABSTRACT

A valve arrangement is configured to rectify a volumetric flow supplied by a hydraulic pump to a first pump connection or second pump connection. The valve arrangement includes a first suction valve arranged between a suction-side connection of the valve arrangement and the first pump connection. The valve arrangement also includes a second suction valve arranged between the suction-side connection and the second pump connection. The valve arrangement also includes a first pressure valve arranged between a pumping-side connection of the valve arrangement and the second pump connection. The valve arrangement also includes a second pressure valve arranged between the pump-side connection and the first pump connection. The first suction valve is acted on by the pressure of the second pump connection in the opening direction. The second suction valve is acted on by the pressure of the first pump connection in the opening direction.

8 Claims, 2 Drawing Sheets

(51) Int. Cl.
*F04B 49/08* (2006.01)
*F04B 49/22* (2006.01)

(56) References Cited

FOREIGN PATENT DOCUMENTS

DE 10 2005 059 565 A1 6/2007
DE 10 2007 044 451 A1 3/2009

OTHER PUBLICATIONS

Liu, Direct Drive Volume Control Electro-hydraulic System, Machine Tool & Hydraulics, Nov. 2009, pp. 233-238, vol. 11, issue 37, Harbin Heilongjiang, China.

* cited by examiner

VALVE ARRANGEMENT, CONNECTION PLATE FOR A HYDROSTATIC PISTON MACHINE, AND HYDROSTATIC PISTON MACHINE

This application is a 35 U.S.C. §371 National Stage Application of PCT/EP 2011/003928, filed on Aug 5, 2011, which claims the benefit of priority to Ser. No. DE10 2010 035 457.0, filed on Aug 26, 2010 in Germany, the disclosures of which are incorporated herein by reference in their entirety.

The disclosure relates to a valve arrangement for rectifying a volumetric flow which is delivered by a hydraulic pump into a first or second pump connection, to a corresponding connection plate having the valve arrangement, and to a hydrostatic piston machine having a connection plate of this type.

BACKGROUND

Hydrostatic pumps are frequently constructed in such a way that they can be driven in two directions. If, however, the rotational direction of the drive is reversed, the delivery direction is also reversed. It is therefore frequently required to ensure rectification of the volumetric flow which is produced. This means that a suction-side connection and a delivery-side connection of the entire pump unit retain their function even in the case of a change in the rotational direction of the pump. For this purpose, it is known to arrange four valves in what is known as a Graetz circuit. Here, as is shown in DE 42 34 139 C2, a first suction valve is arranged between a first pump connection and the suction-side connection of the pump unit and a second suction valve is arranged between a second pump connection and the suction-side connection of the pump unit. Furthermore, a first pressure valve is arranged between the second pump connection and a delivery-side connection of the pump unit and a second pressure valve is arranged between the first pump connection and the delivery-side connection of the pump unit. Depending on the delivery direction, the pump then delivers toward the first pump connection or the second pump connection, whereas it sucks in pressure medium at the respectively other pump connection. For example, in the case of a first delivery direction, pressure medium is sucked in from the suction-side connection of the pump unit via the first suction valve and is sucked in by the pump at the first pump connection. The pump delivers toward the second pump connection, with the result that the pressure medium is fed via the first pressure valve to the delivery-side connection of the pump unit. On account of the pressure conditions which are produced, in contrast, the second suction valve and the second pressure valve are moved into their closed position and are held there by the delivery pressure.

It is problematical in the case of the proposed valve arrangement that in the case of jamming or sticking in the described case example of the first suction valve which is opened only by the vacuum, the pressure medium which is conveyed by the pump toward the delivery-side connection cannot be replenished. This can lead to damage of the pump. The valve arrangement which is described here is preferably arranged in a connection plate of a hydrostatic piston machine and forms a pump unit together with the latter. In order then to make the opening of the suction valve to be opened possible reliably, it is already known to connect the valve bodies of the two suction valves to one another. As a result, one of the two valves is always open. The force which is exerted in the closing direction by the delivery pressure on the suction valve which is connected to the delivery-side pump connection is therefore used to open the suction valve which is connected to the suction-side pump connection. However, this variant has the disadvantage that jamming of the connecting rod or the valve bodies which are connected thereto can occur.

It is therefore the object to provide a valve arrangement, a connection plate and a hydrostatic piston machine, in which reliable opening of the suction valve which is situated on the respective suction side is ensured.

The object is achieved by the valve arrangement according to the disclosure, the connection plate and the corresponding hydrostatic piston machine.

SUMMARY

In the valve arrangement according to the disclosure for rectifying a volumetric flow which is fed by a hydraulic pump to a first or a second pump connection, to this end the suction valve which is situated in each case on the suction side of the pump is moved into its open position by means of the pressure medium which is delivered by the pump. The valve arrangement has a first suction valve which is arranged between a suction-side connection of the valve arrangement and the first pump connection, a second suction valve which is arranged between the suction-side connection and the second pump connection, a first pressure valve which is arranged between a delivery-side connection of the valve arrangement and the second pump connection, and a second pressure valve which is arranged between the delivery-side connection and the first pump connection.

In order to make the hydraulic opening of a suction valve possible, the first suction valve is loaded in the opening direction with the pressure of the second pump connection. As an alternative or in addition, the second suction valve is loaded in the opening direction with the pressure of the first pump connection. Loading of this type achieves a situation where, without a mechanical connection of the two suction valves, a force as a result of the generated high pressure of the pump is used to open the suction valve which is arranged on the suction side in each case. Although the generation of a volumetric flow is in principle possible only after the opening of the corresponding suction valve which is situated on the suction side, it is already sufficient for opening the valve if, as a result of the pump which is starting up, a pressure increase occurs at the pump connection which is oriented toward the delivery side. This is already sufficient, for example, to overcome sticking of the valve body on its valve seat and to open the valve piston of the suction valve reliably.

The valve arrangement according to the disclosure is mechanically simple and can nevertheless ensure reliable functioning. On account of the lower number of mechanical components, it also requires a smaller installation space. Since, in addition, all the connections which are required to actuate the respective suction-side suction valve are present in any case in the connection plate of a hydrostatic piston machine, the valve arrangement is preferably provided in a connection plate of a pump unit. The connection plate forms a hydrostatic piston machine, preferably together with the pump.

Advantageous developments are described herein.

The pressure which is present at the delivery-side pump connection is preferably fed to a face of a valve body which is configured as a step piston. Additional mechanical components can therefore be dispensed with completely and the valve body is loaded directly in the opening direction of the respective suction-side suction valve with the pressure of the delivery-side pump connection.

A particularly favorable arrangement results if the two valve bodies of the two suction valves in the connection plate lie opposite one another and are arranged in a common stepped bore. Here, as a result of the omission of the mechanical connection, the flow cross section is increased which results between the two valve bodies in the intake region and has previously led to a loss on account of the increase in the flow resistance. That section of the common stepped bore which is formed between the two valve bodies can therefore be connected particularly favorably to the suction-side connection of the pump unit. This leads to a further reduction in the installation space, since the flow cross sections are not reduced further by the mechanical connection.

There is also a further reduction in the installation space by virtue of the fact that in each case one volume which is connected to the first pump connection and the second pump connection is penetrated by a section of the valve body of the first suction valve and the second suction valve, respectively. The connecting channel for feeding the pressure to the respectively other valve body can then be arranged in this section.

BRIEF DESCRIPTION OF THE DRAWINGS

In the following text, the disclosure will be explained in detail with reference to the drawings, in which.

DETAILED DESCRIPTION

Figure 1:
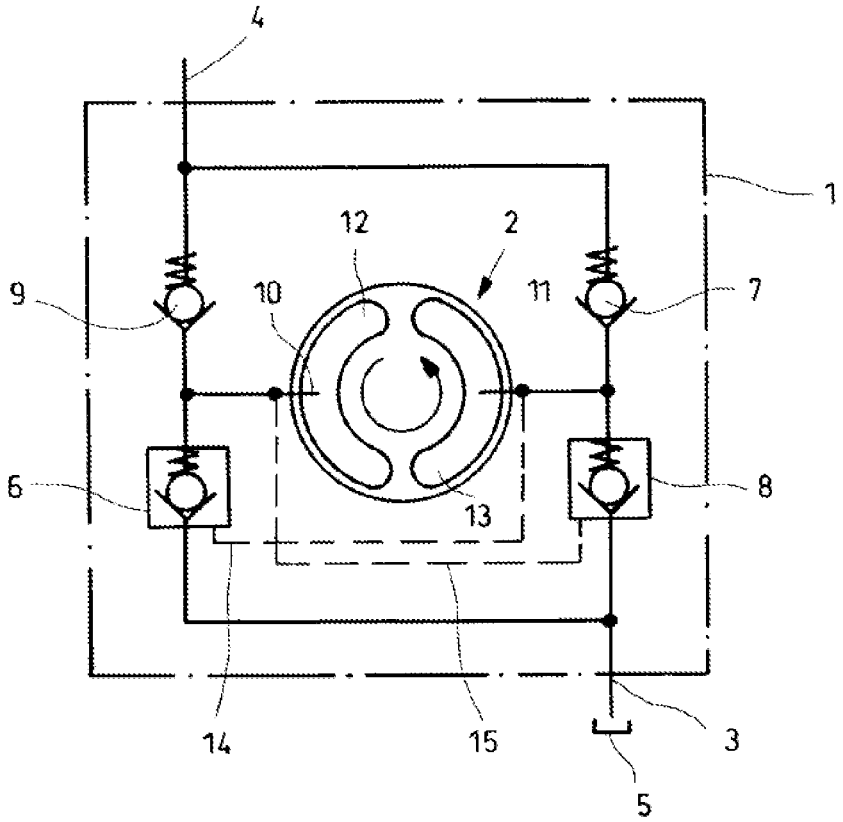
FIG. 1 shows a diagrammatic illustration of the valve arrangement according to the disclosure using the example of the connection to a control plate of a hydrostatic axial piston machine.

FIG. 1 shows a diagrammatic illustration of a pump unit 1 having a pump 2. The pump 2 is represented here by a control plate and forms the pump unit 1 together with the valve arrangement which is shown. The pump unit 1 is provided for delivering pressure medium to a delivery-side connection 4 of the pump unit 1, which pressure medium is sucked in via a suction-side connection 3.

A first suction valve 6, a first pressure valve 7, a second suction valve 8 and a second pressure valve 9 are provided for rectifying the volumetric flow which is generated by the pump 2. All four valves 6-9 are configured as nonreturn valves which are loaded in the closing direction by way of a spring. The first suction valve 6 is arranged between the suction-side connection 3 of the pump unit 1 and a first pump connection 10. The second suction valve 8 is arranged between the suction-side connection 3 and a second pump connection 11. The pump connections 10, 11 are the interface between the pump 2 and the valve arrangement. The first pump connection 10 is connected to a first control kidney 12 of the control plate of the hydrostatic piston machine. The second pump connection 11 is connected to a second control kidney 13 of the control plate. The two suction valves 6, 8 are arranged in such a way that they open toward the pump connection 10, 11 which is connected in each case to them.

The first pressure valve 7 is arranged between the second pump connection 11 and the delivery-side connection 4 of the pump unit 1, whereas the second pressure valve 9 is arranged between the first pump connection 10 and the delivery-side connection 4. The two pressure valves 7, 9 are arranged in such a way that they open toward the delivery-side connection 4 of the pump unit 1.

The two suction valves 6, 8 are configured in such a way that the suction valves 6, 8 can be moved into their respectively open position by feeding in of pressure medium. In order to bring about opening of this type by means of hydraulic force, a first connecting channel 14 is connected to the first suction valve 6, the end of which first connecting channel 14, which faces away from the first suction valve 6, is connected to the second pump connection 11. In the same way, the second suction valve 8 is connected to the first pump connection 10 via a second connecting channel 15.

The function of the valve arrangement which is shown is then as follows: if, as a result of driving of the pump 2 in a first direction, pressure medium is sucked in from the first control kidney 12 and is delivered into the second control kidney 13, the first suction valve 6 and the first pressure valve 7 open. In order to promote the opening operation of the first suction valve 6, the pressure which is available in the second control kidney 13 and therefore the second pump connection 11 is fed via the first connecting channel to the first suction valve 6. In contrast, the second connecting channel 15 is pressureless and the second suction valve 8 is held in its closed position by the pressure which prevails at the second pump connection 11. The second pressure valve 9 is likewise held in its closed position on account of the active pressure gradient. The pump unit 1 therefore sucks pressure medium in from a tank volume 5 via the suction-side connection 3 and delivers it to the delivery-side connection 4 which can be connected to a hydraulic consumer.

When the pump is stopped, the valves close on account of the spring forces and therefore return into the basic position.

If the rotational direction of the pump is then reversed, the control kidneys 12, 13 change their function. Pressure medium is then sucked in via the second control kidney 13 and therefore the second pump connection 11 and is delivered into the first control kidney 12 and therefore the first pump connection 10. The pressure gradients which occur then ensure that the first suction valve 6 and the first pressure valve 7 are kept closed. In contrast, the second pressure valve 9 is opened, as is the second suction valve 8 on account of the pressure which prevails at the first pump connection 10 via the second connecting channel 15. As a result, this again leads to delivery of pressure medium to the delivery-side connection 4, which pressure medium is sucked in via the suction-side connection 3. The connections 3, 4 therefore retain their function with regard to the pump unit 1, in a manner which is independent of the rotational direction.

Figure 2:
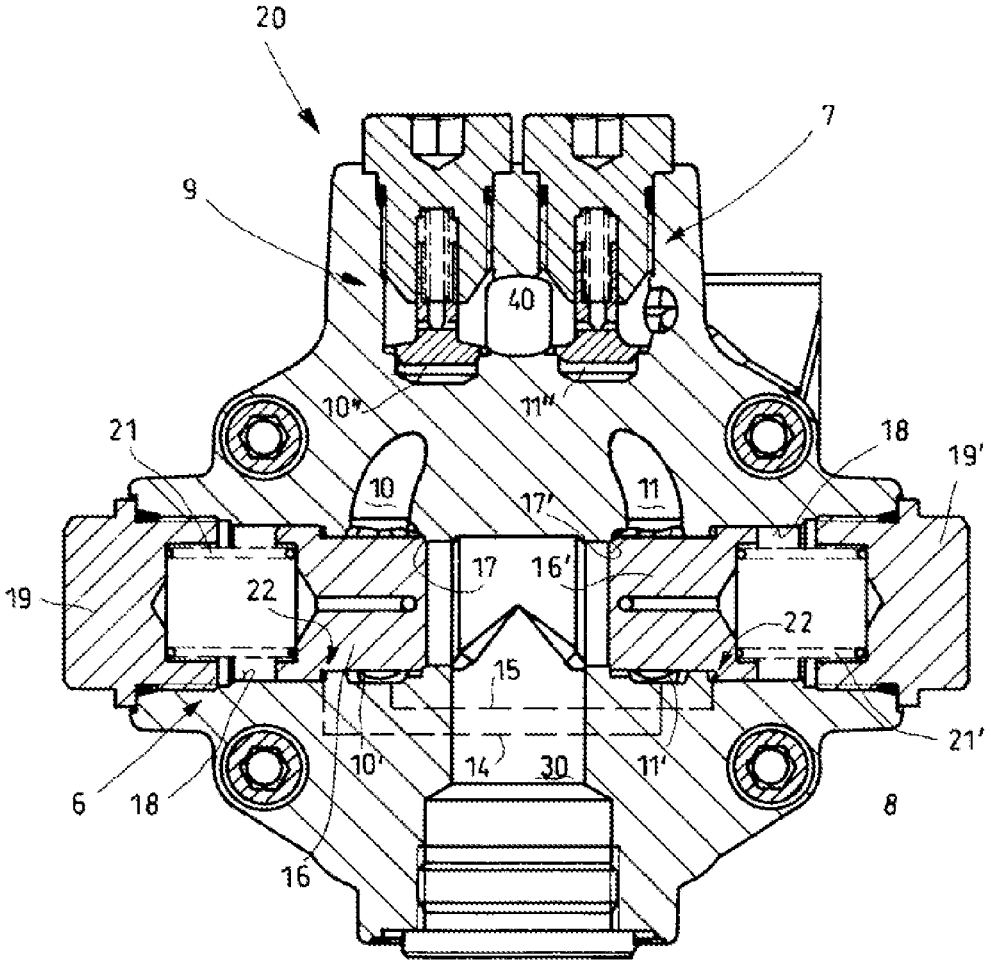
FIG. 2 shows a section through a connection plate of a hydrostatic axial piston machine.

FIG. 2 shows a structural exemplary embodiment of a connection plate 20 of the hydrostatic axial piston machine which is shown diagrammatically in FIG. 1. The connection plate 20 exhibits the first suction valve 6 and, lying opposite on a common center axis, the second suction valve 8. Furthermore, the first pressure valve 7 and the second pressure valve 9 are arranged in the connection plate 20 next to one another with parallel center axes. The two pressure valves 7, 9 are arranged in in each case one blind bore, which are connected to one another via a common transverse bore. Here, a further channel 40 is provided which leads to the delivery-side connection 4. This arrangement is known per se and is therefore not described in detail. In the closed state of the two pressure valves 7, 9, the closing bodies of the two pressure valves 7, 9 disconnect the channel 40 and therefore the suction-side connection 4 from the first pump connection 10 and the second pump connection 11. The first pump connection 10 is connected to a volume 10" which is formed on the end side of the closing body of the second pressure valve 9. In contrast, the second pump connection 11 is connected to a volume 11" which is formed on the end side of the closing body of the first pressure valve 7.

In the following text, the construction and arrangement of the suction valves 6, 7 in the connection plate 20 will be explained. In order to avoid unnecessary repetitions, the details will be explained merely in conjunction with the first suction valve 6. The corresponding elements are provided in FIG. 2 with primed designations for the second suction valve 8.

The first suction valve 6 has a valve body 16. In the closed state, the valve body 16 seals against a sealing seat 17 of a stepped through hole 18. Starting from the sealing seat 17 toward the outer side of the connection plate 20, the stepped through hole 18 has a further radial step which increases the diameter toward the outer side of the connection plate 20. In a corresponding manner to said step, a step 22 is formed on the valve body 16 in a manner which is spaced apart from its end side which is oriented toward the center of the connection plate 20. Here, the axial extent of the valve body 16 between the sealing seat 17 and the radial step 22 is dimensioned in such a way that the two radial steps of the through hole 18 and the valve body 16 enclose an annular space. This enclosed volume is connected via the first connecting channel 14 to the second pump connection 11. In the exemplary embodiment which is shown, the second pump connection 11 is connected to a volume 11' which surrounds the valve body 16' of the second suction valve 8 annularly. In the same way, the second connecting channel 15 connects an annular volume 10' of the first pump connection 10, which annular volume 10' surrounds a section of the valve body 16, to the volume which is formed in front of the radial step of the valve body 16' of the second suction valve 8.

The valve body 16 is kept in contact with the sealing seat 17 by means of a helical spring 21. The helical spring 21 is supported on one side on the valve body 16 and on the other side on a screw plug 19. The screw plug 19 closes the through hole 18.

The first pump connection 10 is connected to the first control kidney 12 and the second pump connection 11 is connected to the second control kidney 13. The first suction valve 6 is constructed symmetrically with respect to the second suction valve 8. A suction channel 30 which is connected to the suction-side connection 3 of the pump unit 1 is connected to that region of the through hole 18 which is situated between the two valve bodies 16, 16' of the suction valves 6, 8. As a result of the hydraulically assisted opening of the first suction valve 6 and of the second suction valve 8, the positive coupling, known from the prior art, of the two valve bodies 16, 16' of the suction valves 6, 8 is dispensed with. The free flow cross section in the suction channel 30 and the adjoining through hole 18 is therefore enlarged and the suction losses are reduced. In particular, as a result of the hydraulic opening of the suction valves 6, 8, the precise orientation of the center axes of the through hole parts for the first suction valve 6 and the second suction valve 8 can be dispensed with. This is indispensable in the case of mechanical coupling, in order to avoid jamming of the two valve bodies which are connected mechanically to one another. As a result of the mechanically decoupled opening assistance by means of the pressure medium which is delivered by the pump 2, the through hole 18 can be produced by drilling from two sides, without hundred percent alignment of the two holes being required. The increase of a positional tolerance of this type does not influence the function of the valve arrangement according to the disclosure, the connection plate 20 according to the disclosure and the corresponding hydrostatic piston machine.

The invention claimed is:

1. A valve arrangement for rectifying a volumetric flow which is fed by a hydraulic pump to a first pump connection or a second pump connection, the valve arrangement comprising:

a first suction valve arranged between a suction-side connection of the valve arrangement and the first pump connection;

a second suction valve arranged between the suction-side connection and the second pump connection;

a first pressure valve arranged between a delivery-side connection of the valve arrangement and the second pump connection; and a second pressure valve arranged between the delivery-side connection and the first pump connection, wherein:

the first suction valve opens the first pump connection to the suction-side connection when loaded in an opening direction of the first suction valve with pressure of the second pump connection, and the second suction valve opens the second pump connection to the suction-side connection when loaded in an opening direction of the second suction valve with pressure of the first pump connection.

2. The valve arrangement as claimed in claim 1, wherein:

the first suction valve has a valve body configured as a step piston having a face formed on a step, the face configured to be loaded in the opening direction of the first suction valve with pressure of the second pump connection, and the second suction valve has a valve body configured as a step piston having a face formed on a step, the face configured to be loaded in the opening direction of the second suction valve with pressure of the first pump connection.

3. A connection plate for a hydrostatic piston machine comprising:

a valve arrangement arranged in the connection plate, the valve arrangement including:

a first suction valve arranged between a suction-side connection of the valve arrangement and a first pump connection;

a second suction valve arranged between the suction-side connection and a second pump connection;

a first pressure valve arranged between a delivery-side connection of the valve arrangement and the second pump connection; and a second pressure valve arranged between the delivery-side connection and the first pump connection, wherein:

the first suction valve opens the first pump connection to the suction-side connection when loaded in an opening direction of the first suction valve with pressure of the second pump connection, and the second suction valve opens the second pump connection to the suction-side connection when loaded in an opening direction of the second suction valve with pressure of the first pump connection; and at least one of a first connecting channel and a second connecting channel, the first connecting channel provided in the connection plate and configured to load the first suction valve in the opening direction of the first suction valve with the pressure of the second pump connection, and the second connecting channel provided in the connection plate and configured to load the second suction valve in the opening direction of the second suction valve with the pressure of the first pump connection.

4. The connection plate as claimed in claim 3, wherein:

the first suction valve has a valve body and the second suction valve has a valve body, and the valve bodies are arranged in the connection plate so as to lie opposite one another and are arranged in a common stepped bore.

5. The connection plate as claimed in claim 4, wherein:

a section of the common stepped bore is formed between the valve bodies, and the section of the common stepped bore is connected to the suction-side connection.

6. The connection plate as claimed in claim 4, wherein:

the valve body of the first suction valve has a section configured to penetrate a volume which is connected to the first pump connection, and the valve body of the second suction valve has a section configured to penetrate a volume which is connected to the second pump connection.

7. The connection plate as claimed in claim 6, wherein:

the valve body of the first suction valve has a face formed on a first side, the valve body of the second suction valve has a face formed on a second side, the faces are configured to be loaded in the opening directions of the first suction valve and the second suction valve, respectively, and the first side and the second side are configured to face away from one another.

8. A hydrostatic piston machine comprising:

a connection plate including:

a valve arrangement arranged in the connection plate, the valve arrangement including:

a first suction valve arranged between a suction-side connection of the valve arrangement and a first pump connection;

a second suction valve arranged between the suction-side connection and a second pump connection;

a first pressure valve arranged between a delivery-side connection of the valve arrangement and the second pump connection; and a second pressure valve arranged between the delivery-side connection and the first pump connection, wherein:

the first suction valve opens the first pump connection to the suction-side connection when loaded in an opening direction of the first suction valve with pressure of the second pump connection, and the second suction valve opens the second pump connection to the suction-side connection when loaded in an opening direction of the second suction valve with pressure of the first pump connection; and at least one of a first connecting channel and a second connecting channel, the first connecting channel provided in the connection plate and configured to load the first suction valve in the opening direction of the first suction valve with the pressure of the second pump connection, and the second connecting channel provided in the connection plate and configured to load the second suction valve in the opening direction of the second suction valve with the pressure of the first pump connection.

* * * * *